United States Patent [19]

Krasnoff et al.

[11] 4,192,219

[45] Mar. 11, 1980

[54] HYDRAULIC ACTUATOR

[75] Inventors: Eugene L. Krasnoff, Princeton; Herman Lindeboom, Pennington, both of N.J.

[73] Assignee: Ingersoll-Rand Company, Woodcliff Lake, N.J.

[21] Appl. No.: 2,445

[22] Filed: Jan. 10, 1979

Related U.S. Application Data

[60] Division of Ser. No. 890,382, Mar. 27, 1978, Pat. No. 4,142,447, which is a continuation of Ser. No. 699,493, Jun. 24, 1976, abandoned, which is a continuation-in-part of Ser. No. 533,969, Dec. 18, 1974, abandoned.

[51] Int. Cl.[2] ..... F01L 17/00

[52] U.S. Cl. ..... 91/276; 91/280; 91/281; 91/317

[58] Field of Search ..... 91/276, 280, 281, 317, 91/318, 341 R, 300

[56] References Cited

U.S. PATENT DOCUMENTS

| | | | |
|---|---|---|---|
| 3,592,109 | 7/1971 | Eskridge | 91/276 |
| 3,739,863 | 6/1973 | Wohlwend | 91/317 |
| 3,853,036 | 12/1974 | Eskridge | 91/276 |
| 3,896,889 | 7/1975 | Bouyoucos | 91/276 |

FOREIGN PATENT DOCUMENTS

| | | | |
|---|---|---|---|
| 1250431 | 11/1958 | France | 91/317 |

*Primary Examiner*—Abraham Hershkovitz
*Attorney, Agent, or Firm*—Frank S. Troidl

[57] ABSTRACT

A hydraulically operated reciprocating piston and a differential force operated valve are both in continuous fluid contact with a pressurized cushion chamber as well as the piston chamber pressure. The valve position is a function of the cushion chamber pressure. The cushion chamber pressure is a function of the axial position of the piston. The values of these functions are such that the piston is reciprocated when the machine is operated. The valve is a sleeve coaxial with the piston.

3 Claims, 5 Drawing Figures

HYDRAULIC ACTUATOR

This application is a Division of our copending application Ser. No. 890,382, filed Mar. 27, 1978, now U.S. Pat. No. 4,142,447 entitled "HYDRAULIC ACTUATOR", which is a continuation of Ser. No. 699,493, filed June 24, 1976, now abandoned, which is a continuation-in-part of Ser. No. 533,969, filed Dec. 18, 1974, now abandoned.

This invention relates to hydraulic actuators. More particularly, this invention is a new and novel differential force controlled hydraulic actuator including a pressure controlled valve for reciprocating a piston.

Hydraulic actuators usually have a reciprocating piston controlled by hydraulic fluid flow into or out of the piston chamber through axially separated sets of ports. Hydraulic actuators are usually controlled by some sort of "position" control; that is, the application of hydraulic pressure against a piston to reciprocate the piston is dependent upon the position of the piston, itself, that is, a set of ports is open or closed, depending on the position of the piston, or a valve opens or closes the sets of ports to control the flow of hydraulic fluid to and from the piston chamber.

With position type hydraulic actuators, particularly high impacting force devices, a position change of the load or anvil will cause excessive variation in reaction forces. With handheld tools, these reaction forces can be bothersome to the operator.

Our new hydraulic actuator includes a purely pressure controlled valve for controlling the flow of liquid into and out of one or more working cylinders of an actuator. The driving pressure force is nearly constant and this produces a low reaction force on the case. With our pressure controlled device, the case reaction remains relatively insensitive to position changes of the load or anvil.

Hydraulic impact tool actuators built for the high flow energy required in demolition work, tamping, and rock drilling are plagued by severe pulsation problems. These pulsations lead to early failure of actuator parts and supply or discharge line fittings. With currently used actuators, gas accumulators or the equivalent are employed with the resulting operating costs associated with maintaining required gas pressures.

In our new hydraulic actuator, pressure pulsations are minimized without the use of gas accumulators or excessively large volumes of hydraulic fluid.

Briefly described, our new hydraulic actuator comprises a housing with a pressurized cushion chamber, and a piston chamber interconnected by a bore of less diameter than either the cushion chamber or the piston chamber. During the entire cycle, the piston extends from the piston chamber through the interconnecting chamber and into the cushion chamber. The structure of the piston is such that the piston chamber and cushion chamber are substantially pressure isolated from one another during the entire cycle. The piston is provided with a cushion pressure surface which is continuously subjected to the cushion chamber pressure. The axial position of the piston cushion pressure surface controls the cushion pressure. A valve is also continuously subjected to the operating pressure and exhaust pressure. As the piston moves downwardly, the cushion chamber pressure and therefore the force exerted against the valve is decreased. When a predetermined differential force exists, the valve is shifted to its second position to permit the application of hydraulic fluid against the piston to reverse the direction of movement of the piston. As the piston thereafter moves upwardly, the cushion chamber pressure continuously increases. When the differential force reaches a predetermined amount, the valve is then shifted to its first position. The cycle is continuously repeated as long as the hydraulic actuator is being operated.

The valve comprises a slidable sleeve coaxial with the piston. The sleeve has an inside diameter substantially equal to the diameter of the piston shoulders.

The invention, as well as its many advantages, may be further understood by reference to the following detailed description and drawings in which.

In the various figures, like parts are referred to by like numbers.

Figure 1:
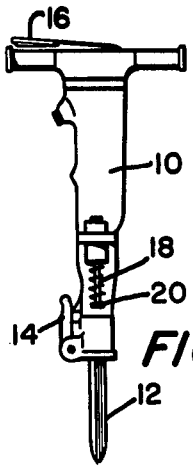
FIG. 1 is an elevational view of a paving breaker in which our new hydraulic actuator may be used.
Figure 4:
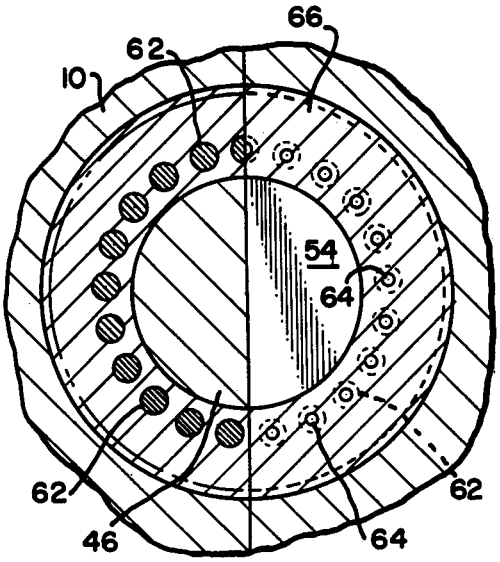
FIG. 4 is a view generally drawn along lines 4—4 of FIG. 2.

Referring to the drawings, and more particularly, to FIG. 1, there is shown a paving breaker including a housing 10 to which is attached means for breaking pavements such as breaker 12. The breaker 12 is attached to the bottom of the housing 10 by means of a pivoted lever 14. To operate the paving breaker, the operator presses handle 16 downwardly. A coaxial spring 18 is mounted about the bolt 20 and helps absorb shock.

It is to be clearly understood that although we have illustrated our new hydraulic actuator in a paving breaker, the hydraulic actuator can be used for any other use for which hydraulic actuators are used. Our invention is in a pressure-operated hydraulic actuator and not restricted to use in a paving breaker.

Figure 2:
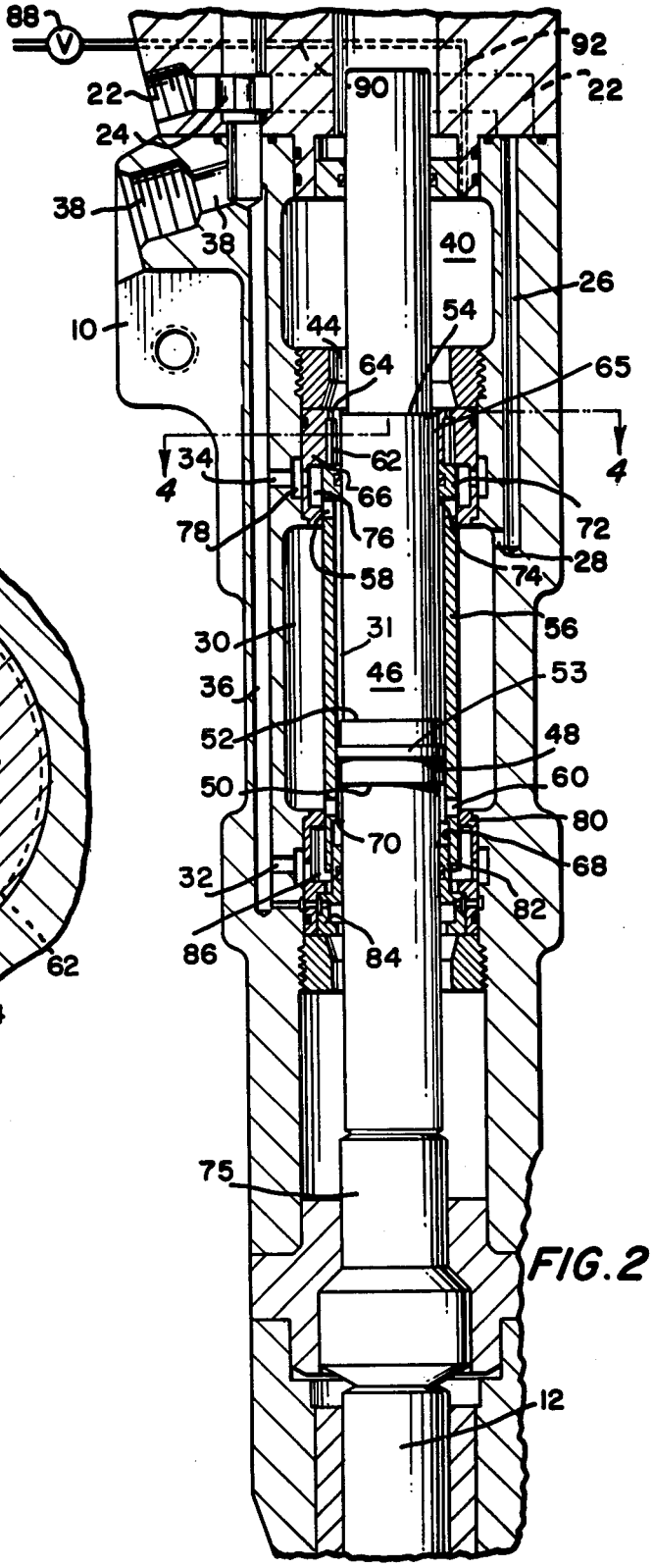
FIG. 2 is an enlarged sectional view of the novel components of our new hydraulic actuator showing a sleeve valve in one position.

Referring more specifically to FIG. 2, hydraulic fluid is fed to the housing 10 by means of fluid lines, such as line 22 controlled by valve 24. The fluid is fed from line 22 to a longitudinally extending pressure line 26, and transversely extending line 28, through chamber 30, through ports 60 in sleeve 56, and into piston chamber 31. Hydraulic fluid is exhausted from the piston chamber 31 through ports 58 in sleeve 56, chamber 76, chamber 78, and exhaust fluid line 34. The exhaust fluid line 34 runs into the longitudinally extending fluid line 36 and from the housing by means of fluid line 38 near the top of the housing.

Within the housing there is provided a pressurized cushion including a pressurized cushion chamber 40 and a bore 44 extending downwardly from the cushion chamber. The reciprocating piston 46 has a longitudinal portion 48 of greater diameter than the remainder of the piston, thus providing a first shoulder 50 and second shoulder 52. Annular seal 53 on longitudinal portion 48 provides a close fit of the portion 48 with the wall of piston chamber 31. A cushion pressure shoulder 54 on the piston 46 is continuously subjected to the pressure in the cushion chamber 40 and bore 44.

The pressurized cushion is always substantially pressure isolated from the piston chamber 31 during the entire piston reciprocating cycle. An interconnecting bore 65 in pin retainer 66 has a smaller diameter than the diameter of bore 44 of the cushion and a smaller diameter than the diameter of piston chamber 31. Piston 46 extends through piston chamber 31, through bore 65 and into the pressurized cushion including bore 44 and cushion chamber 40. That part of piston 46 which moves within interconnecting bore 65 has a diameter substantially the same as the diameter of the interconnecting bore.

In the embodiment shown in FIG. 2, the pressure operated valve includes the slidable sleeve 56 coaxial with the piston 46. The inside diameter of the sleeve is substantially equal to the diameter of the longitudinal portion 48 of piston 46. A first set of circumferentially evenly spaced ports 58 and a second set of circumferentially evenly spaced ports 60 longitudinally spaced from the first set of ports are provided in the slidable sleeve 56.

A plurality of pins 62 are held against the end of the sleeve facing the cushion chamber 40. The pins 62 are circumferentially equally spaced on the end of the sleeve 56. The top part of each pin 62 is continuously subjected to the cushion pressure through ports 64 formed in the pin retainer 66. A port is provided for each pin. In the particular embodiment shown there are twenty-one ports 64 and twenty-one pins 62. Of course, any particular number of pins and ports may be used if desired.

The sleeve 56 has at its lower end a bore 68 of greater inside diameter than the diameter of the rest of the sleeve thus providing a downwardly extending annular shoulder 70. (See FIGS. 2 and 3). The extreme upper portion 72 of the sleeve 56 has a bore substantially the same size as the piston 46 thus providing a downwardly extending annular shoulder 74. The O-ring isolates the pressure in piston chamber 31 from the cushion pressure.

In the operation of the embodiment shown in FIGS. 1 through 5, FIG. 2 shows the relative positions of the sleeve 56 and the piston 46 with the piston 46 in its lowermost position striking the anvil 75, which in turn strikes the breaker 12. Note that the ports 60 are not closed by the piston portion 48. The cushion pressure has just reached a low enough pressure so that the sleeve 56 has been shifted to its uppermost position so that the ports 60 are exposed to chamber 30 and ports 58 are exposed to the exhaust lines.

Hydraulic fluid is fed into fluid line 22, through open valve 24, through longitudinally extending line 26, transverse line 28, chamber 30, ports 60 and into piston chamber 31. This fluid pressure is exerted upwardly against the shoulder 50 on longitudinal portion 48 of the piston 46 and also upwardly against the annular shoulder 70 on sleeve 56. The force on shoulder 50 moves the piston 46 upwardly against the force exerted against annular shoulder 54.

Initially, the operating force on annular shoulder 70 plus the exhaust force on annular shoulder 74 is greater than the force operating against the pins 62 through ports 64, thus tending to keep the valve sleeve 56 in the upper position shown in FIG. 2.

As the piston moves upwardly, hydraulic fluid is exhausted from piston chamber 31 through ports 58, chamber 76 in pin retainer 66, chamber 78 in the housing 10, ports 34, longitudinal line 36, and line 38. Also, as the piston 46 moves upwardly, the hydraulic fluid in the cushion is pressurized by shoulder 54, thus increasing the pressure in the cushion chamber 40. This increased pressure is transmitted through bore 44 and ports 64 against the pins 62. Before the piston 46 reaches its uppermost position, the force against pins 62 exceeds the opposing operating force against annular shoulder 70 in sleeve 56 plus the opposing exhaust force against annular shoulder 74 in the sleeve. The sleeve 56 is then snapped downwardly to the position shown in FIG. 3. Ports 58 are continuously open to exhaust during the entire upward movement of the piston and never closed by the piston.

Figure 3:
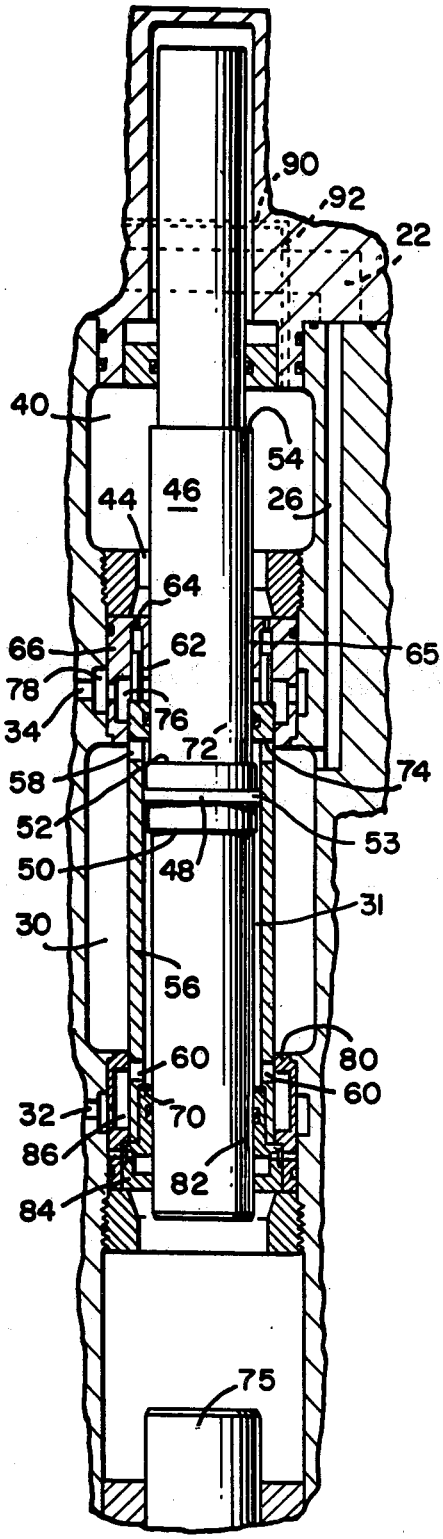
FIG. 3 is an enlarged sectional view showing the sleeve valve in the second position.
Figure 5:
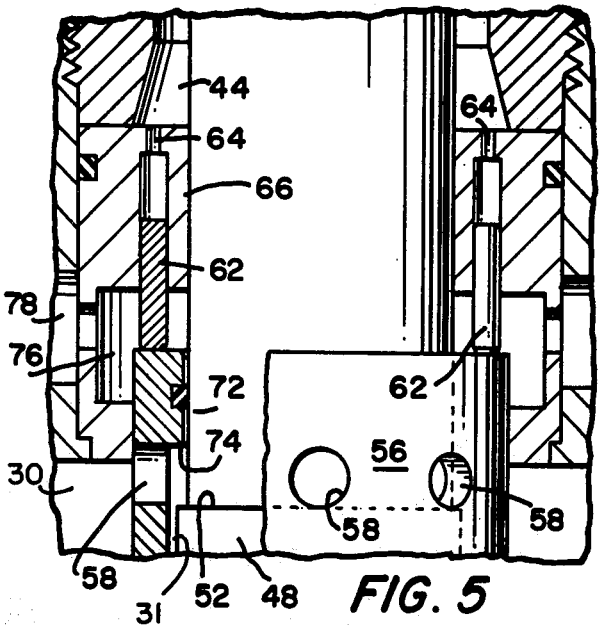
FIG. 5 is an enlarged view, partly in section, showing certain details of the sleeve valve and the pin retainer.

As shown in FIG. 3, the sleeve has been moved downwardly to expose piston chamber 31 to chamber 30 through ports 58. Ports 60 are exposed to the exhaust lines. The annular shoulder 70 in sleeve 56 abutts against the flange 82 in the lower bearing 84.

Fluid from the chamber 30 is then fed through ports 58 in sleeve 56 against shoulder 52 on the longitudinal portion 48 of piston 46. Also, the pressure from chamber 30 works against shoulder 74 on the upper portion 72 of sleeve 56. Fluid in the sleeve 56 is exhausted from the sleeve through ports 60, bore 86 in lower bearing sleeve 80, transverse fluid line 32, and longitudinal fluid line 36 (see FIG. 2 and FIG. 3). Exhaust pressure is also exerted against lower shoulder 70 in sleeve 56.

As piston 46 moves downwardly, the pressure of the hydraulic fluid in the cushion chamber decreases. As the force operating against the pins 62 decreases, it will reach a predetermined operating force where said force is less than the force against annular shoulder 72 plus the force against annular shoulder 70. This force is reached just before the piston 46 strikes the anvil 75. Sleeve 56 is then shifted back to the position shown in FIG. 2; and the cycle continuously repeated.

During the operation of this invention, either ports 58 or ports 60 are exposed to chamber 30. At no time are both ports 58 and ports 60 shut off from chamber 30. Thus, fluid from chamber 30 is never dead-ended and pressure pulsations are minimized. Also, during the entire cycle of the piston neither ports 58 or ports 60 are ever closed by the piston.

If desired, the predetermined pressure range in cushion chamber 40 may be made adjustable for flexibility of the cycle. For this purpose, a valve 88 is provided in line 90 (see FIG. 2). This valve controls the flow of liquid into cushion chamber 40 through line 90 and line 92.

We claim:

1. A hydraulic actuator comprising: a liquid source for supplying an operating pressure to a housing, the housing having a pressurized cushion chamber; a piston chamber formed by a slidable sleeve, a piston mounted within said housing and coxial with the slidable sleeve, said piston extending through the sleeve and into the pressurized cushion chamber, said piston having a first liquid pressure surface in the piston chamber and a second liquid pressure surface in the piston chamber, said piston also having a cushion chamber liquid pressure surface which alternately, continuously increases the pressure of the liquid in the cushion chamber during movement of the piston in one direction and continuously reduces the pressure of the liquid in the cushion chamber during movement of the piston in the other direction as the piston reciprocates; and piston reciprocating means comprising valve means including a valve member and said slidable sleeve, said slidable sleeve having axially spaced sets of ports, the ports supplying operating pressure to the piston chamber; the piston reciprocating means further comprising hydraulic flow conduits controlled by said valve member; said sleeve being biased in a first direction by having a first portion thereof continuously directly subjected to the cushion chamber pressure, said valve member and said hydraulic flow conduits being constructed so that during the entire cycle the operating pressure acts in a direction opposite said first direction on a second portion of the sleeve to oppose the bias resulting from the pressure on the sleeve first portion, the operating and cushion pressures and the dimensions of the piston cushion chamber liquid pressure surface and sleeve first and second portions being chosen such that said sleeve begins moving to a first position when the pressure in the cushion chamber relative to said operating pressure reaches a first predetermined level to permit the application of operating pressure to said first liquid pressure surface, said sleeve beginning to move to a second position when the pressure in the cushion chamber reaches a second predetermined level relative to said operating pressure to permit the application of operating pressure to said second piston liquid pressure surface.

2. A hydraulic actuator in accordance with claim 1 wherein a portion of the longitudinal end of the slidable sleeve facing the cushion chamber is the first portion continuously subjected to the cushion chamber pressure.

3. A hydraulic actuator in accordance with claim 2 wherein the operating pressure is supplied to the piston chamber by way of a first set of ports in the sleeve when said sleeve is in the first position and the operating pressure is supplied to the piston chamber by way of a second set of ports when said sleeve is in the second position.

* * * * *